US012753660B2

(12) United States Patent
Liagov et al.

(10) Patent No.: US 12,753,660 B2
(45) Date of Patent: Oct. 6, 2026

(54) DEVICE FOR GENERATING AN AXIAL LOAD IN A DRILL STRING ASSEMBLY

(71) Applicant: PGI HOLDING LIMITED, Dubai (AE)

(72) Inventors: Ilia Liagov, Ufa (RU); Alexander Liagov, Ufa (RU); Marina Kachemayeva, Ufa (RU)

(73) Assignee: PGI HOLDING LIMITED, Dubai (AE)

( * ) Notice: Subject to any disclaimer, the term of this patent is extended or adjusted under 35 U.S.C. 154(b) by 293 days.

(21) Appl. No.: 17/511,435

(22) Filed: Oct. 26, 2021

(65) Prior Publication Data

US 2022/0049560 A1 Feb. 17, 2022

Related U.S. Application Data

(63) Continuation of application No. PCT/RU2020/000062, filed on Feb. 7, 2020.

(51) Int. Cl.
*E21B 19/086* (2006.01)
*E21B 19/089* (2006.01)

(52) U.S. Cl.
CPC ..... *E21B 19/086* (2013.01); *E21B 19/089* (2013.01)

(58) Field of Classification Search
CPC ..... E21B 19/086; E21B 19/089
(Continued)

(56) References Cited

U.S. PATENT DOCUMENTS 1,445,086 A * 2/1923 Joy ..... E21B 19/084 173/147
3,169,584 A * 2/1965 Stenuick ..... E21B 4/14 173/18

(Continued)

FOREIGN PATENT DOCUMENTS

CN 105625958 A 6/2016
GB 2243315 A * 10/1991 ..... E21B 17/07

(Continued)

OTHER PUBLICATIONS

Liagov I.A. et al., Sozdanie tekhnicheskoi sistemy "Perfobur" i issledovanie ee raboty v silno iskrivlennom kanale pri vynuzhdennykh prodolnykh kolebaniakh. Elektronny nauchny zhurnal "Neftegazovoe delo". 2015. No. 5. p. 57-75.

*Primary Examiner* — Robert F Long
(74) *Attorney, Agent, or Firm* — BCF LLP

(57) ABSTRACT

The invention relates to drilling equipment. A device for generating an axial load in a drill string assembly with a bottomhole motor powered by drilling fluid comprises a hollow cylinder barrel and a spring-loaded flow-through plunger rod with a key, the rod and key forming a subassembly. The hollow cylinder barrel is provided with a sealing collar and with bilateral longitudinally oriented grooves that are arranged along the internal generatrix of the cylinder barrel and receive with longitudinal and transverse clearance the key, having a profiled surface, such that the key is capable of moving along the grooves together with the flow-through plunger rod. The length of the bilateral longitudinally oriented grooves is dependent on the maximum length of the working stroke of the flow-through plunger rod. The result is an improvement in the operating efficiency of the drill string together with expanded functional capabilities.

3 Claims, 8 Drawing Sheets

(58) Field of Classification Search
USPC ..... 173/1–2, 13, 18–20, 90, 184, 29–31, 173/38–39, 45–53
See application file for complete search history.

(56) References Cited

U.S. PATENT DOCUMENTS 3,190,374 A * 6/1965 Caperan ..... E21B 7/067 285/55
3,722,603 A * 3/1973 Brown ..... E21B 19/16 173/159
4,082,151 A * 4/1978 Finney ..... B25D 11/102 173/203
4,114,698 A * 9/1978 Webb ..... E21D 3/00 175/85
4,243,112 A * 1/1981 Sartor ..... E21B 4/02 464/155
4,250,973 A * 2/1981 Hall ..... E21B 19/24 173/147
4,428,439 A * 1/1984 Moreno ..... B25D 11/102 74/56
4,441,564 A * 4/1984 Castillo ..... E21B 7/02 175/122
4,817,736 A * 4/1989 Ono ..... B25D 11/102 173/93.5
5,269,107 A * 12/1993 Klemm ..... E21B 7/021 52/115
5,427,188 A * 6/1995 Fisher ..... B25D 11/102 173/205
5,607,265 A * 3/1997 Lane ..... B23D 57/0076 144/48.6
5,628,446 A * 5/1997 Geiste ..... A61B 17/0684 227/176.1
5,794,325 A * 8/1998 Fallandy ..... B25D 11/108 29/566.4
6,059,661 A * 5/2000 Simpson ..... E21B 23/00 464/178
6,135,212 A * 10/2000 Georgiou ..... B25B 21/02 173/93.5
6,315,059 B1 * 11/2001 Geldean ..... E21B 7/028 173/147
7,506,693 B2 * 3/2009 Stirm ..... B25D 11/005 173/205
7,640,998 B2 * 1/2010 Howell, Jr. ..... E21B 7/027 173/28
7,743,847 B2 * 6/2010 Fisher ..... B25D 11/102 173/205
8,464,805 B2 * 6/2013 Baumann ..... B25D 17/24 173/109
8,534,527 B2 * 9/2013 Brendel ..... B25C 1/06 227/132
9,771,690 B2 * 9/2017 Henke ..... E01B 29/26
10,099,351 B2 * 10/2018 McGougan ..... B25B 21/00
11,624,236 B2 * 4/2023 Smart ..... E21B 19/24 211/69
2009/0194576 A1 * 8/2009 Wang ..... B25C 1/06 227/146
2011/0114308 A1 * 5/2011 Nikiforuk ..... E21B 19/07 166/380
2012/0247832 A1 * 10/2012 Cramer ..... E21B 7/24 267/140.13
2018/0193993 A1 * 7/2018 Pedicini ..... B25D 17/06

FOREIGN PATENT DOCUMENTS

RU 2116429 C1 7/1998
RU 2439282 C1 1/2012
SU 1514902 A1 10/1989

* cited by examiner

D–D

DEVICE FOR GENERATING AN AXIAL LOAD IN A DRILL STRING ASSEMBLY

CROSS REFERENCE TO RELATED APPLICATION

The present application claims priority to International Application No. PCT/RU2020/000062, filed on Feb. 7, 2020, entitled "Device for generating an axial load in a drill string assembly" which is incorporated by reference herein in its entirety.

PRIOR ART

The invention relates to the drilling equipment, in particular, to the devices for creating optimum axial load on the rock crushing tool in a dynamic disturbance zone of the drill assembly (DA), consisting of units of different rigidity, for perforation of the producing rock in the borehole and well workover by directional drilling of branched ultra-small diameter and curvature radius channels using small mud motors in sharply varying geological setting and, correspondingly, with changing drilling modes.

During the drilling, the load on the drill bit is created by the weight of the pipe string, which is rigidly connected to the bottom hole assembly (BHA) that includes a mud motor and a rock crushing tool (a drill bit or a mill) During the drilling the drill bit forms so-called "tracking" in the bottom hole, at the same time generating reciprocal and oscillating movement of the DA, which negatively affects the performance of the whole BHA.

Uneven or exceedingly high load on the drill bit leads to tooth and bearing chipping, which causes premature wear and affects the reliability of the bearing section of the mud motor, and consequently minimizes the headway per drill bit, while the insufficient axial load leads to lower mechanical drilling strength, which results in lower commercial drilling speed, and may also be one of the reasons for BHA sticking in the drilling process.

BACKGROUND

Prior devices for creating pulse load on the drill bit are known, they not only help to intensify the rock crushing process but also facilitate the drilling assembly travel in a long horizontal borehole due to mechanical vibrations generated by pulsating devices. By applying the load as short pulses perpendicular to the rock face, it is possible to transfer larger amount of energy for crushing the rock and accelerate the drilling process, as well as avoid sticking.

Recommended pulse frequency can be generated by means of a system of hydraulic hammers, mechanical vibration generators and magnetostrictive devices [1].

Source [2] suggested a method and documented results of experimental research conducted for a rock crushing mechanism with a diamond bit, to which impact pulses are transferred with a high-frequency hydraulic hammer. When tested in hard solid rocks and fractured dolomites the increase in mechanical drilling speed was about 50%.

In a known drill bit (inv. certificate SU No. 840270), when the stream of fluid passes through the system of flushing ports, it is divided by a splitter. As the stream of fluid meets a bluff obstacle, it breaks and form vortices. Occasional pressure changes in the vortex zone lead to ultrasonic vibrations in the drill bit.

A drilling apparatus (U.S. Pat. No. 4,243,112) has a vibrator with a bearingless rotor, freely orbiting the case.

Due to this, a periodic horizontal force directed normal to the bit rotation axis is generated in the vibrator plane.

However, due to faults caused by vibrations in telemetric system used to perform measurements and monitor drill parameters and the well bore trajectory, such devices cannot be used in a small drilling assembly.

A known drilling method [3, 4] using high-velocity jets (as the main rock crushing tool) has been applied abroad, but it turned out to be completely unprofitable. Prior arts in this field are known, inv. certificate SU No. 883312 and No. 927950. Only a combination of mechanical and jet rock crushing mechanism has succeeded in the drilling practice, and such combination presents difficulties for placing in ultra-small well bores.

Jets intensify the drilling process but require large pressure differential and high fluid consumption, which leads to notable loss of pressure in small tubings, loss of fluid through mandrel bearing units in the small mud motors, fast wear and considerable excess hydraulic impact forces on the pay zone.

Drilling with high-pressure mud pulse [4] is used abroad mainly using near-bit devices. U.S. Pat. No. 4,071,097 proposes a process and a device for ultrasonic drilling. For that purpose, the drill bit is equipped with a resonance chamber and a mud vibration-exciting element. As a result, the speed of drilling grew almost twice. U.S. Pat. No. 4,607,792 describes an invention with a cumulative nozzle coupled with a launch tube. Within said launch tube, in front of a piston located in it, a liquid package is formed establishing a transient hydrodynamic seal of the nozzle tip and a temporary (transient) partial vacuum. In a known drill bit (U.S. Pat. No. 4,114,705) two pulsed jets are formed, flow rate in each jet switching instantaneously between zero and a maximum value, due to a ball that oscillates between the two closure positions in a distribution chamber, closing corresponding output duct in each of the closure positions.

A known hydraulic drill, inv. certificate SU No. 1188327, has a solid disc with radial blades on the surface facing the jet nozzles and rotating in the stream of mud.

Generation of pulse jets in the drill bits requires considerable pressure changes and high consumption of the washing fluid in the drilling assembly and leads to considerable burden on the pay zones, which negatively affects the pressure connectivity in the well-formation system and, in the end, is unacceptable for solving the below stated technical objective and achieving the below stated technical results due to above mentioned reasons.

There are known hydraulic loaders for drilling tools with anchors. A device, according to Patent RU No. 2116429, has a hollow spindle, which is provided with means for its connection to drilling string, and drilling bit, made up of the upper part and the lower part connected to each other by splined joint, which holds them from relative turning. The upper part of the spindle has power cylinders with power pistons inside them. The upper part has a hydraulic anchor body, which, together with a hollow telescopic shaft, forms a hydraulic chamber connected with the annular space through holes. Hydraulic anchor is provided with extending supporting members installed in radial holes of body. Bore is made inside upper part of spindle above power cylinders. Seated in previously mentioned bore is control valve made in the form of a stepped bush with radial holes. The stepped bush has bottom spring latches, which may latch on the fixing step. Lower part of spindle above pistons has tailpiece with a turned slot, and the length of this slot is equal to working stroke of pistons.

A known device under patent RU No. 2081991 for creating axial load on rock-crushing tool includes a hydraulic loader in the form of hollow body and piston which is installed in body together with rod, and an anchor unit made in the form of tube which is concentrically and with clearance for passing of drilling fluid secured on the drill string, and a flexible hose arranged on pipe with its ends hermetically clamped on pipe. The hollow space of the hose is connected with the hollow space of the drill string through pipe unions.

The device for axial loading of drill bit (patent RU No. 2236533) includes a hollow body with a spring-loaded hollow piston and an electromagnetic coil, and a motorized anchor.

Known drill bit drives transform the energy of the mud flow into axial load transferred to the drill bit and damp the longitudinal vibrations of the drill tubing.

This function can be performed by axial loading devices for drill bit (inv. certificate SU No. 1427054 and 1446270, patent RU No. 2194839, patent U.S. Pat. No. 5,884,716, patent WO No. 9512051), and telescopic drill rods (inv. certificate SU No. 1479607, 1587167) and near-bit dampers (inv. certificate SU No. 735846, 802513, 842294, 911066, 1073430, 1084502, 1079814, 1108271 and 1406333, patent RU No. 2185493, patent DE No. 19857479).

The most acceptable and reliable way to improve the efficiency of the drilling process in the mentioned area is using the drill bit drives. They create higher axial load on the rock-crushing tool by using both anchor and anchorless hydraulic loaders.

Anchorless loaders are preferable as the use of various types of anchors may hinder the removal of the cuttings, their deposition in the horizontal bore, and it may also lead to sticking. Use of anchors in open holes, when the quality of cements is inadequate, may lead to wall caving in the anchorage points.

A known device under patent WO No. 9512051 has a telescoping outer tubular member and inner tubular member, which form an annular chamber and a slotted connection. Inside the chamber, there are springs and a power piston. Due to the features of this structure, very high fluid pressure on the power piston is required to create the desired load on the tool, while the linear dimensions of the device are rather large, which is unacceptable as a solution for the below stated technical objective and as a way to achieve the below stated technical result.

A known device under U.S. Pat. No. 5,884,716 the inner hollow piston with a power rod is extended through telescoping under the weight of the drill string. The piston rod approaches the restrictor, which is fixedly disposed in the lower part of the system. When the piston rod enters the restrictor, pressure increases in the device cavity, and this is the signal to stop axial displacement and to start the mud motor for working the rock with the drill bit. Such loader design is also unacceptable for solving the technical objective presented below and for achieving the technical result described below due to above-mentioned reasons.

Working-face feed mechanism (inv. certificate SU No. 1427054) has a hollow housing with a moving piston with a control unit installed inside it, which consists of a plate, a sleeve and two flexible rods placed in longitudinal notches of the ring piston and in the windows of the movable rod. Hydraulic chambers formed by the cylinders and power pistons installed in the housing are connected with the annular space through radial openings. As the axial load is transferred to the drill bit, the movable rod causes the plate to move horizontally, the passage area of the device is restricted, and the pressure in it grows. During the drilling under the pressure from the mud, the power piston moves and displaces it from the hydraulic chambers into the annular space. The detriment of the device, which prevents it from use to achieve the below described technical results, is its low reliability due to solids from the mud entering into the gaps between the movable and the flexible rods and hydraulic impacts when the plate closes the central axial channel.

A device for creating axial load on the drilling equipment, drilling bit loading complex, under patent RU No. 2194839, including a device made of separate modules, whose bodies are combined by reactive subs with formation of cylinder block, and each cylinder has a piston connected via driving shaft to drilling bit. Pistons divide the cylinder cavities into high and low pressure chambers, which are correspondingly connected, with the internal and the annular space. The movable piston is connected with the body through a spline joint. The detriment of the device that prevents its use for achieving the below described technical results is that it is impossible to reset it without stopping the mud circulation, which leads to poorer bottom hole flushing quality and cuttings deposits in horizontal bore holes, as well as lack of function to generate oscillating operating modes.

The closest technical solution of the claimed invention for creating the axial load is an anchorless device for creating an axial load on the drill bit (inv. certificate SU No. 1446270) with a hollow body with a spring-loaded shaped figure rod with axial and radial holes. The rod has a nozzle with coaxial and axial channels, which is placed in the upper cavity of the body, and it interacts with the upper and lower limiting protrusions in the cavity. The cross-section area of the axial channel is less than the cross-section area of the axial aperture in the rod. The lower cavity has a number of plate springs. When the nozzle stops against one of the protrusions in the upper cavity, the mud pressure increases, which is a signal for the rod reaching the upper or the lower position.

A serious detriment of the device that prevents it from being used to achieve the below described technical result in ultra-small wells is a large probability of hydraulic impact in the drill string, i.e. lower drilling process reliability, which may even lead to drilling tools breakage, and the lack of function to generate oscillations in the string of required frequency and amplitude, so the probability of sticking cannot be excluded.

Another detriment of the device is its limited functionality due to the fact that it can work only in the longitudinal vibrations damping mode and does not allow for their generation when the sticking probability arises for BHA.

SUMMARY OF THE INVENTION

It is desirable that the claimed invention expands the functionality, improves the technical (operational) efficiency, reliability and performance of the device.

The technical result of the invention is an improvement of the drilling rig efficiency due to optimization of the axial load on its units and the rock breaking tools, reduction of the sticking (including differential sticking) and tool lock-in probability, stabilization of the assembly motion trajectory during the drilling of directional perforation channels, and drilling performance improvement in the ultra-small boreholes with horizontal branches.

The said technical result is achieved within the embodiment of the invention as follows: an axial load device is fitted in the drill string assembly with a downhole drilling motor, operating with mud, including a hollow cylinder body with a sealing bush, a spring-loaded flow-type piston rod with a key, and the hollow cylinder body that has two-way longitudinal key slots along the inner generator line of the cylinder body; in the said slots a key with longitudinal and transverse gaps and profiled surface adapted to move along the body slots together with the flow-type piston rod, and the gaps are such that the profiled key has at least two degrees of freedom in the body slots and in the flow-type piston rod slots for axial movements relative to the cylinder body; while the flow-type piston rod and the profiled key are made with the possible formation of an assembly unit, the profiled key is adapted in a way that its main natural vibration frequency is directly proportional to its length and the velocity of propagation of the generated flexural wave over its body and inversely proportional to the square of its thickness; and the length of the two-way longitudinal slots is determined based on the maximum stroke of the flow-type piston rod operating in the Eulerian area of stable equilibrium, considering its moment of inertia of a cross section and the permissible critical stress generated by the optimum axial load on the drill bit, which is determined by the operating characteristics of the mud motor: correspondingly, by the maximum possible torque and the performance factor.

An alternative embodiment of the claimed technical solution has two-way longitudinal slots along the inner generator line of the cylinder body parallel to its axis, or as a helical involute spiral rising on the left or on the right, and the rise angle of the spiral of the two-way longitudinal slots of the hollow cylinder body is the same as the angle of possible torsion of the drill string under the reactive torque of the mud motor, but with the opposite sign, An alternative embodiment of the claimed technical solution has spring-loaded flow-type piston rod and a profiled key, An alternative embodiment of the claimed technical solution has a streamlined profiled key made as an elastic plate with tapered or rounded ends, or wing-shaped flat and skewed, or with a spherical front surface, symmetrical or asymmetrical drop-shaped, with displaced gravity centre, placed in the piston rod and body slots with the side closest to the gravity centre toward the flow of mud; or turned with the farther side from the gravity centre.

Analysing the characteristic features of the described invention no known analogous solutions related to the possibility of creating several operation modes in systems analogous to DA for drilling were found: in the damping mode or in the self-excited vibrations mode, with different vibration protection and BHA vibration amplification (resonance) coefficients, which gives the device new characteristics, such as improved efficiency together with expanded functionality.

All the elements of the claim are essential, i.e., necessary for the technical result.

BRIEF DESCRIPTION OF THE DRAWINGS

The essence of the claimed technical solution is explained with examples of its embodiment, shown in the attached figures, where:

FIG. 4 also has the following letter indications for sizes: ($L_n$) is the length of the key slots of the body, (l) is the key length and ($L_{cr}$) is the length of the extended part of the piston; also $L_{cr}=L_n-1$; Sections C-C and D-D are shown below, correspondingly in FIGS. 10 and 11;

Following items are indicated in the figures:

Figure 1:
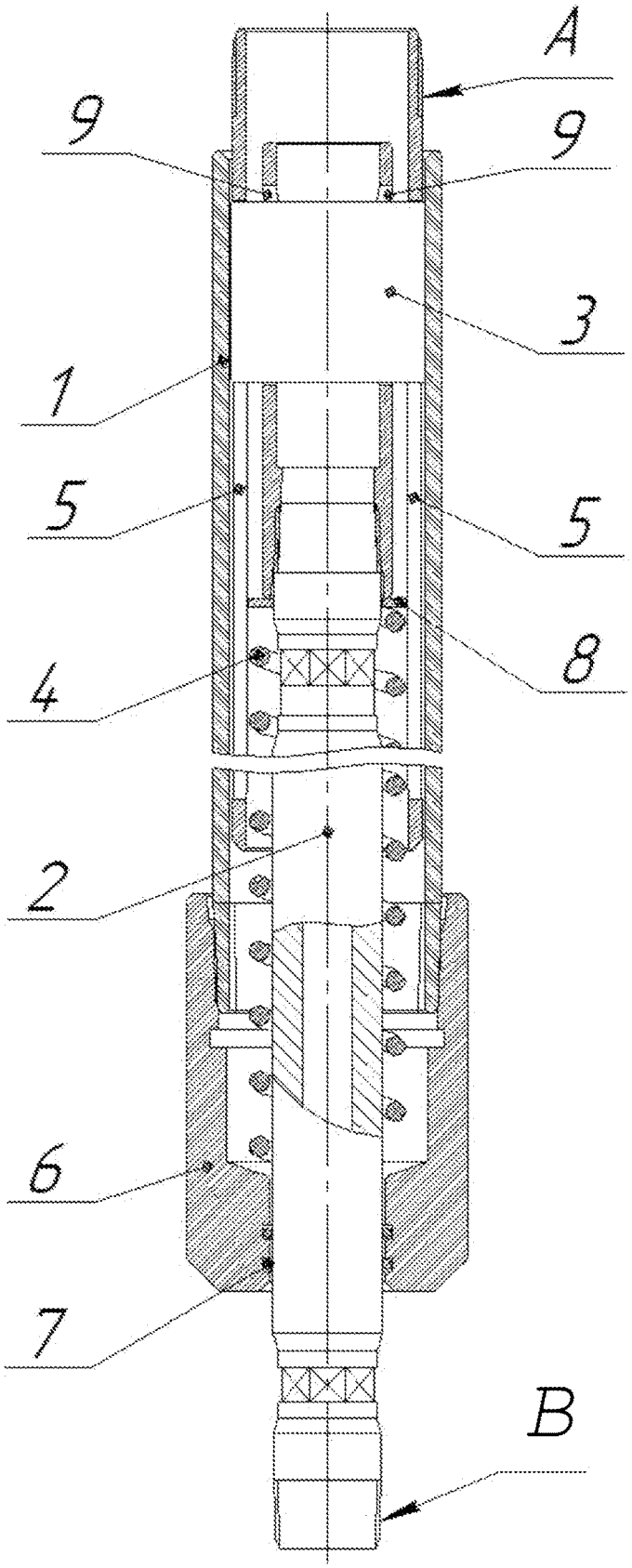
FIG. 1 shows a longitudinal section of the axial load device, with a spring-loaded assembly unit: including a spring-loaded (4) flow-type piston rod (2) with slots (9), in which a key (3) is engaged; the assembly unit is installed inside a body (1) with the possibility of axial motion along the oriented body slots (5), and the spring interacts with the rod through a load washer (8) and with the body through a sealing bush (6) with seals (7); letters A and B indicate threads for connection with the drill string (not shown)
Figure 2:
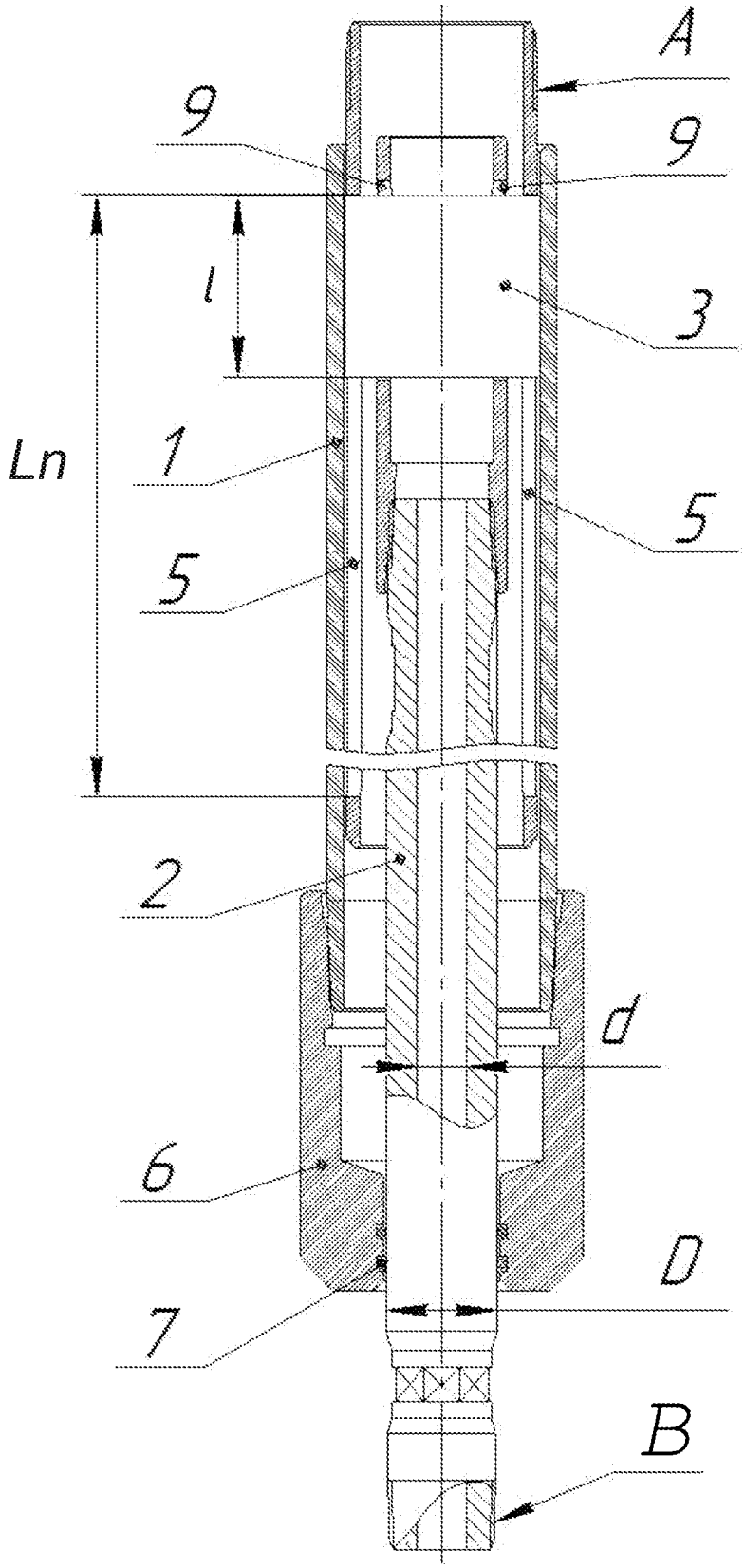
FIG. 2 shows the device without a spring, indications are the same as in FIG. 1.

1—hollow cylinder body (body); 2—flow-type piston rod (piston); 3—key with profiled surface (profiled key, key); 4—spring; 5—oriented key slots of the body (body slots); 6—sealing bush; 7—seals; 8—load washer; 9—slots of the flow-type piston rod (piston slots).

Following items are indicated in the figures with letters: A and B are the threads for connection with the drill string; $L_n$ is the length of the body key slots; l is the length of key; $L_{cr}$ is the length of the extended part of the piston rod (required stroke), and $L_{cr}=L_n-1$; D is the outer diameter of the flow-type piston rod, d is the inner diameter of the flow-type piston rod;

$\Delta x$ is the longitudinal gap of the key in the piston rod slots; $\Delta y$ is the transverse gap of the key in the piston rod and body slots;

$\alpha$ is the rise (turn) angle of the spiral body slots;

h is the key width;

C are the vortex-type flows of fluid;

$V_{fl}$ are the mud velocity values;

ϕ is the angle of the key turn in the slots ("angle of attack" [5])

C-C and D-D are cross-sectional views of the device, correspondingly in the initial position of the key—3 (I) and the end position of the key 3 (II), in a spiral slot, in the end of the piston rod stroke;

a); b) and c) are indications of the versions of the key surface shape;

Equation: $L=(v_k \cdot t)\cdot \sin(\omega_d \cdot t)$ of the movement (L) of the piston rod with a key in the body of the device, in sync with the dynamic processes happening in the bottom hole when the rock is crushed with a drill bit (not shown), e.g. in a quasiharmonic dependency, where $v_k$ is the mechanical drilling speed of the channel or the speed of the key movement with the piston rod within the drilling assembly, t is the time of mechanical drilling, $\omega_d$ is the frequency of the ground-induced drill vibrations [13].

DETAILED DESCRIPTION

The DA operating with drilling mud and consisting of a rock-crushing tool, such as a drill bit, a small mud motor (MM), a string of coiled and rigid drill tubing, is fitted with an axial load device without anchor, for instance, between the coiled and rigid tubing, the said device including a hollow cylinder body with a sealing bush, a spring-loaded flow-type piston rod with a key, which is distinct from the existing options due to two-way longitudinal key slots on a cylinder body, along the inner generator line of the cylinder body parallel to its axis, or as a helical involute spiral with a left or right rise; in the said slots a key with longitudinal and transverse gaps and profiled surface is positioned so that it can move along the body slots together with the flow-type piston rod, and the gaps are adapted for the profiled key to have at least two degrees of freedom in the body slots and in the flow-type piston rod slots for axial movements relative to the cylinder body; meanwhile, the flow-type piston rod and the profiled key are made with the possible formation of an assembly unit, which may be spring-loaded or without a spring, and the shape of the key is selected to be streamlined, such as an elastic plate with tapered or rounded ends, or wing-shaped flat and skewed, or with a spherical front surface, symmetrical or asymmetrical drop-shaped, with displaced gravity centre, placed in the piston rod and body slots with the side closest to the gravity centre toward the flow of mud; or turned with the farther side from the gravity centre, and the dimensions of the key are adapted in a way to make its main natural vibration frequency directly proportional to its length and the velocity of propagation of the generated flexural wave over its body and inversely proportional to the square of its thickness; meanwhile the length of the body slots and, correspondingly, the required stroke of the flow-type piston rod, are selected depending on the performance characteristics of the MM and the operating conditions of the flow-type piston rod in the Eulerian area of stable equilibrium, considering its moment of inertia of a cross section, based on the optimum axial load on MM and the drill bit at permissible values of the critical stress occurring in the piston rod.

The invention describes several possible embodiments of the device that differ in the structural characteristics of the key placement in the oriented slots of the hollow piston rod and in the corresponding slots of the cylinder body, the said slots having various degrees of freedom; in one embodiment it is made with a spring-loaded key within an assembly unit together with the piston rod and with one degree of freedom, and in another embodiment the key is positioned in the guide slots with longitudinal and transverse gaps providing at least two degrees of freedom and the possibility of self-excited vibrations, while in the third embodiment it has the key with different profiles of outer surfaces and positioned in the oriented slots, with a symmetrical or a displaced centre of gravity (mass), with additional slot lines orientation options with rated incline (rise) angles.

The angle of rise of the slot spiral is the same as the torsion angle of the tubing assembly (for example, coiled tubing assembly) placed under the device above the MM, caused by its reactive moment, but with the opposite sign, i.e., with the opposite direction.

Figure 5:
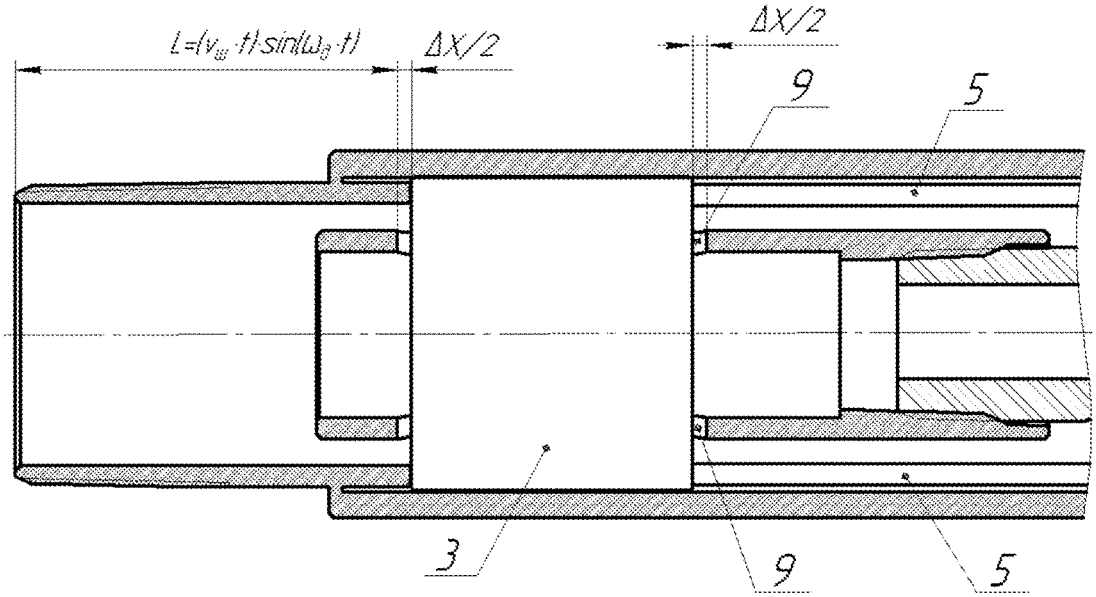
FIG. 5 shows longitudinal gaps of the key positions (3) in the middle of the piston slots (9): $\Delta x/2$, allowing placing the key in the body slots and the piston rod to ensure at least one degree of freedom.
Figure 6:
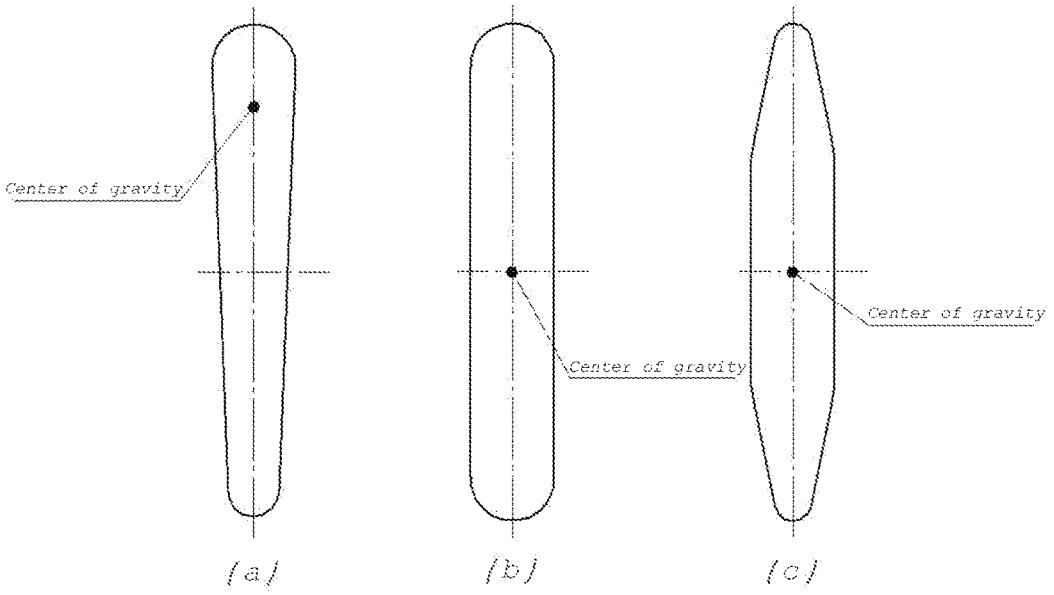
FIG. 6 shows key profile sections (view from above): (a) drop-shaped key with displaced gravity centre; (b) is a symmetrical key with spherical streamlined surfaces; (c) is a plate symmetrical key.
Figure 8:
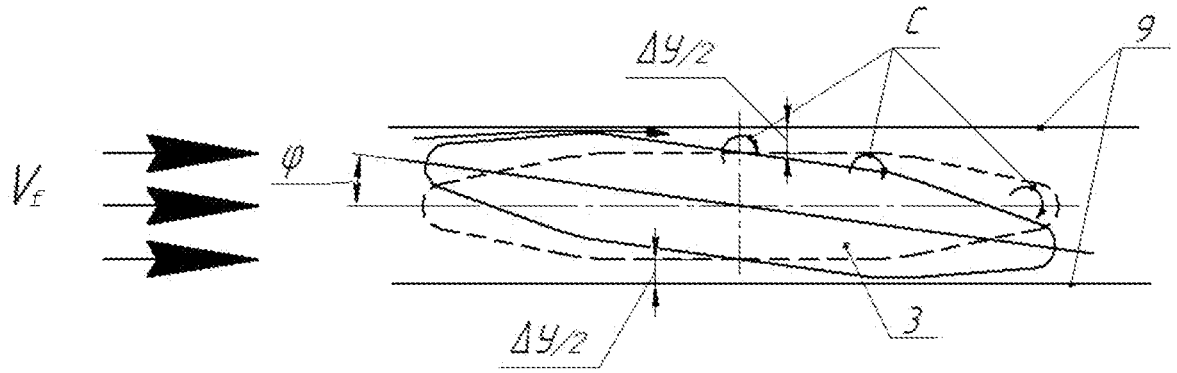
FIG. 8 shows the process of vortex formation (designated by C arrows) on the upper surface of a plate-type key positioned with gaps in slots, when the mud flows around it with velocity $V_{fl}$, and the transverse gap of the key in the piston and body slots: $\Delta y/2$ in the initial moment of time.
Figure 9:
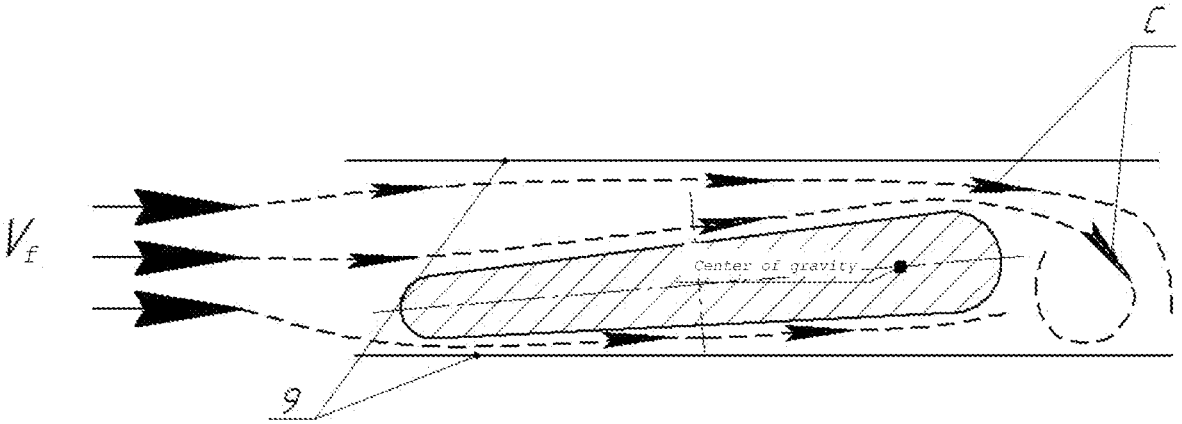
FIG. 9 shows the process of the vortex formation (C arrows) on the upper surface of the drop-shaped key with displaced centre of gravity, when the mud flows around the key with a given velocity ($V_{fl}$)
Figure 10:
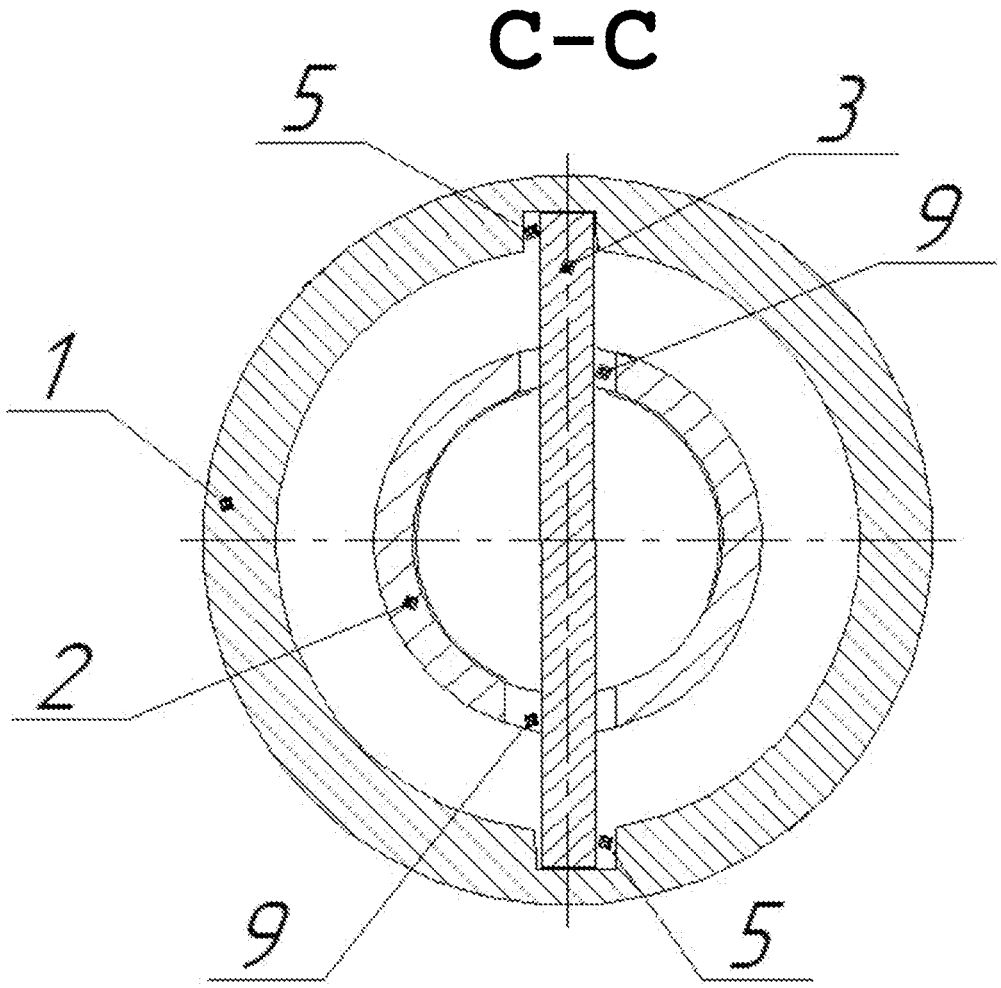
FIG. 10 shows the cross-section C-C of the axial load device indicated in FIG. 4, in the initial position of the key (I).
Figure 11:
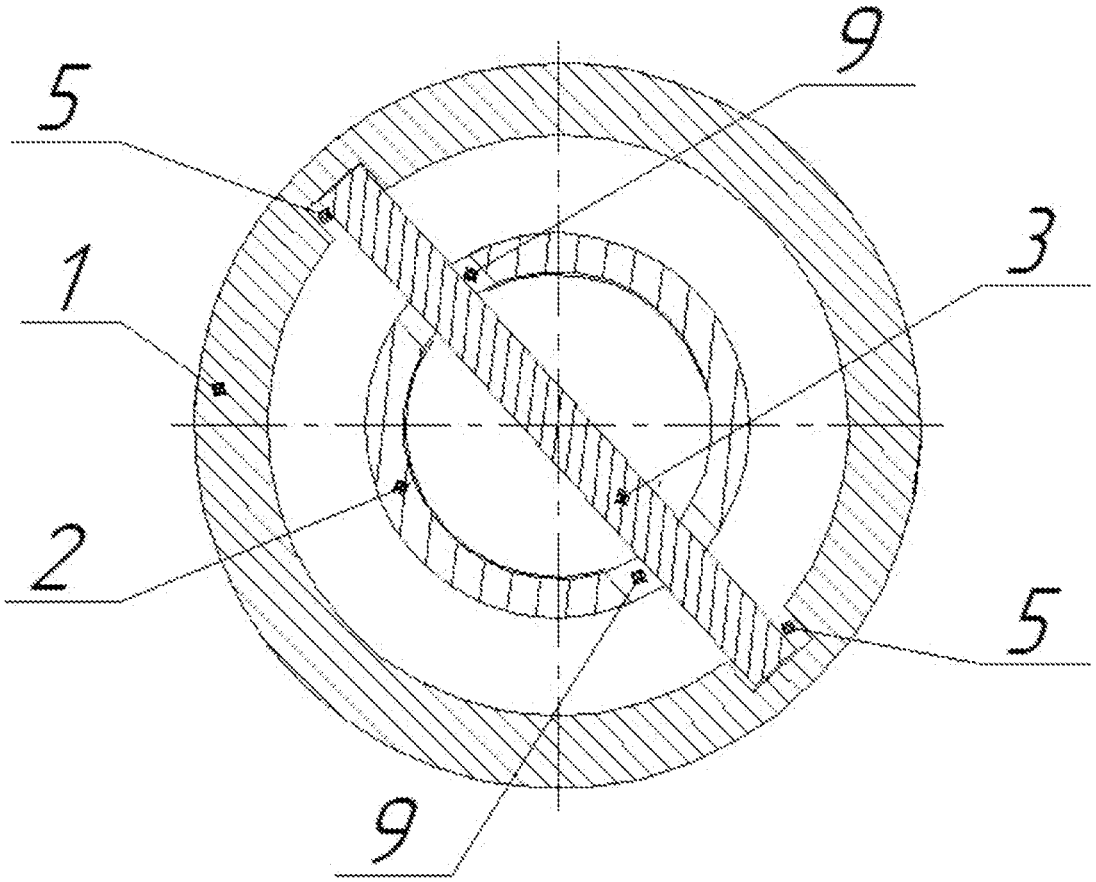
FIG. 11 shows the cross-section D-D of the axial load device indicated in FIG. 4, in the end position of the key, in a spiral slot in the end of the piston stroke (II).

The device in FIG. 1 forms a technical system including a hollow cylinder body (1), with two-way longitudinal slots (5); a sealing bush (6) with sealings (7), a flow-type piston rod (2) with slots (9), where a profiled key (3) is placed with longitudinal and transverse gaps: Δx and Δy (gaps are shown in FIGS. 5 and 8) in the flow-type piston—the rod and the body, so that the key is positioned with at least two degrees of freedom.

Figure 3:
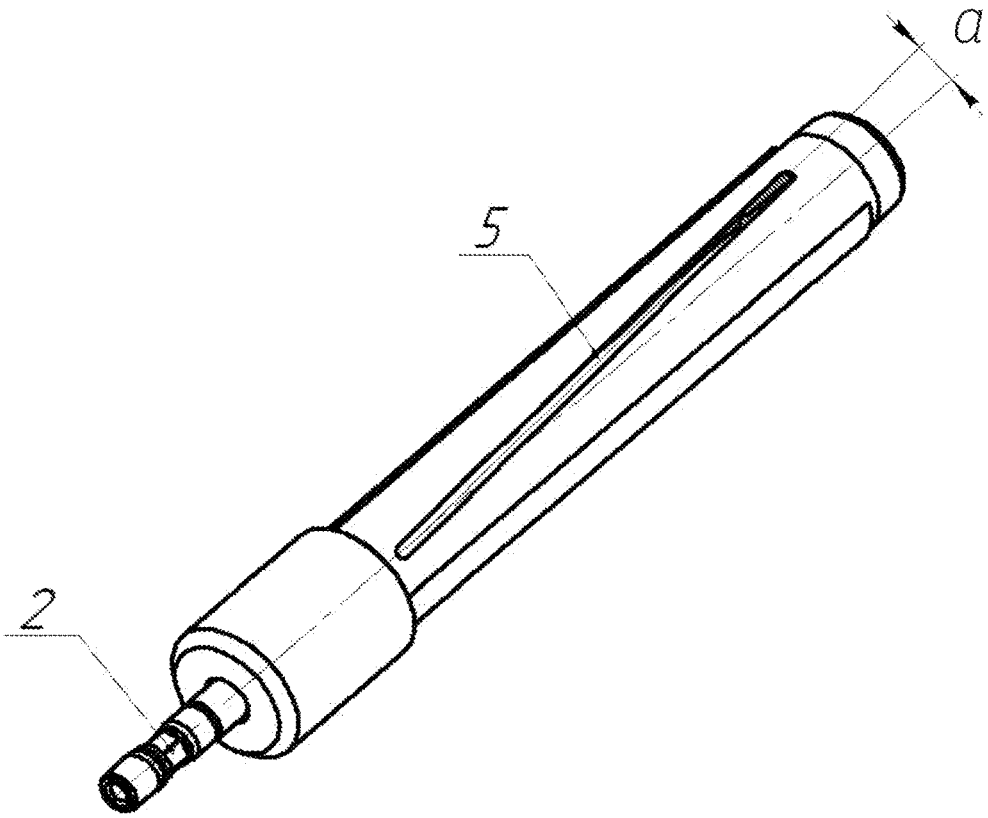
FIG. 3 shows a fragment of the device body part section with a spiral key slot (5) in retracted (transport) piston rod (2) position and an angle ($\alpha$) showing the rise direction (turn of the spiral body slots)
Figure 4:
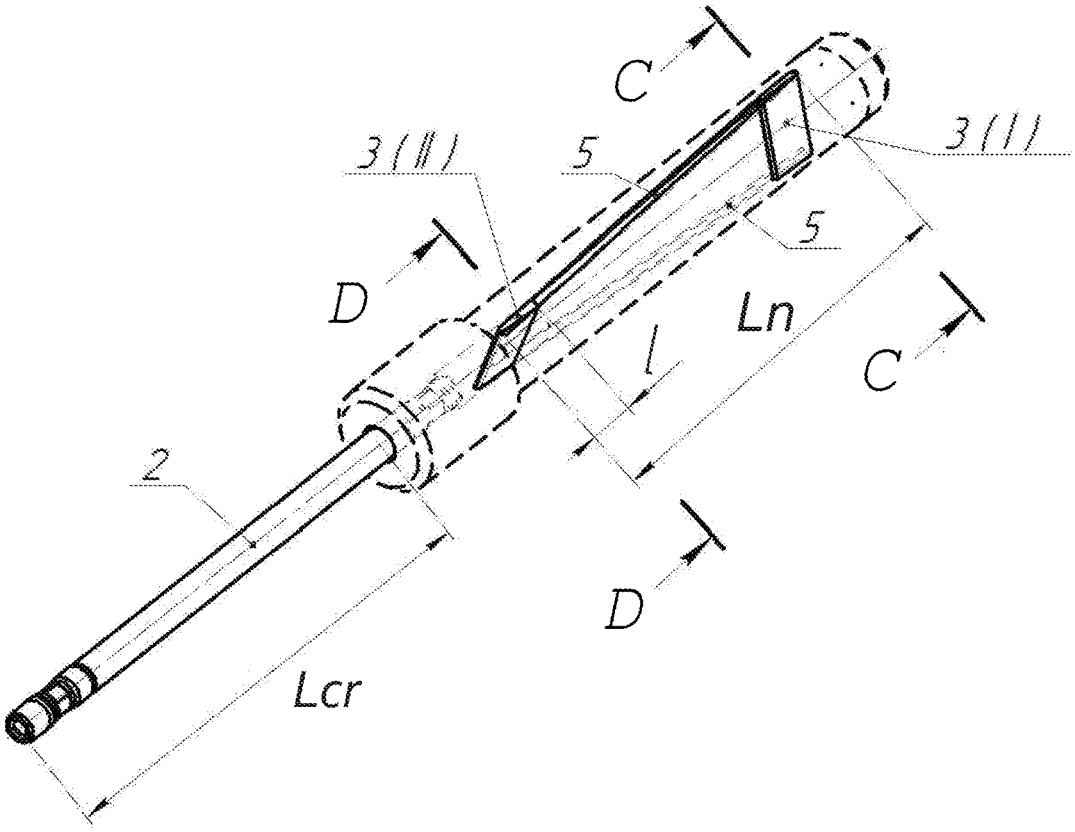
FIG. 4 shows a device with spiral key slots (5) in extended (operating) piston position (2), with the initial position of the key (I), the body, indicated with a dashed line, and the end position of the key (II)

When necessary, longitudinal slots (5) may, aside from the longitudinal position in the body (parallel to the axis of the device), be positioned along the generator line as a helical, for example, involute, spiral (see FIGS. 3 and 4), with a left or right rise, at the rated angle α.

To alter the viscoelastic properties of the mechanical system, the profiled key as an assembly unit together with the piston rod may be spring-loaded (4) with a particular rigidity, which allows for varying force "transmission coefficient" [6]:

$$k = \frac{P_d}{F_p}$$

and the frequency ratio $$\frac{\omega_0}{\omega},$$

where $\omega_0$ the natural frequency of the technical BHA system, ω is the frequency of the disturbing load generated as the rock crushing tool is working; $P_d$ is the dynamic disturbing load on the bottom hole, $F_p$ is the force transferred through the device to the drilling assembly located above. Natural frequencies $\omega_0$ of the BHA technical system can be determined rather precisely for calculations as follows [9]:

$$\omega_0 = \frac{5}{\sqrt{x_t}}$$

where $x_t$ is the linear deformation of the assembly in centimetres, for example, for coiled tubing of the length 12.7 m and diameter 30 mm, wall thickness 2.5 mm, made of steel grade 12Kh18N9T (Young modulus E=(1.3 . . . 1.9)105 MPa); under force $P_d$=0.2 . . . 0.6 kN; $x_t$=0.90 . . . 2.71 cm, $\omega_0$, natural frequency of the coiled tubing assembly will be 5 . . . 3 Hz.

If the fraction, due to geological setting, is expected to be $$\frac{\omega_0}{\omega} > \sqrt{2},$$

then the assembly unit should rather be spring-loaded, for operation in vibration damping mode, and if oscillator mode is required, then the fraction will be selected based on analysis and experiment as $$\frac{\omega_0}{\omega} < \sqrt{2},$$

so the spring is removed from the assembly unit [9,10].

Direction of the slots along which the key moves may be set with an expected (rated) rise angle ($\alpha$), possibly as a spiral involute line, which will prevent possible deviation of the borehole path due to reactive moment from the mud motor or known anisotropy of the rock occurrence (FIG. 3) and the direction (right or left) of the drilled channel (well) trajectory modification.

Angle ($\alpha$) and directions of the body involute slot lines coiling (and their length) are selected depending on the required length of the borehole, mechanical characteristics of the basic elements of BHA, such as the bending and torsional stiffness of the coiled and rigid tubing assembly, power of the mud motor and, correspondingly, its reactive moment, shape of the key and its degrees of freedom when installed in the slots of the device by means of mounting and testing the device with different assembly units and prepared rock blocks [13] at the test bench. A flow-type piston rod transfers controlled axial load on the coiled tubing and further through the MM to the drill bit.

For example, to compensate for the BHA torsion due to the reactive moment of MM when drilling a channel with $L_k$=15 m using a small MM type 2 D 43.5/6.42 (reactive moment of MM is equal to torque $M_{cr}$=70 . . . 80 Nm, length of the motor is 2.3 m) and a coiled tubing with $L_k$=12.7 m, diameter 30 mm and wall thickness 2.5 mm, made of steel 12Kh18N9T, polar moment of inertia of the tubing cross-section is: J=4.12 $10^{-8}$ $M^4$; (G is the shear modulus of elasticity, G=77000 MPa), the expected BHA torsion angle is [14]:

$$\alpha = \frac{M_{cr}}{GJ} L_k = 31.1 \text{ degrees.}$$

Then the rise angle for the body slots, as recommended, is taken with the opposite sign: (–) $\alpha$=–31.1 degrees.

To calculate vibration damping parameters of the device when creating the axial load ("force transfer coefficient") with the spring-loaded assembly unit, a phenomenological model for oscillation system of the dynamically disturbed bottom drill string assembly with the device shown in FIG. 1 (two-mass model) is analysed;

where $m_1$ is the mass of coiled tubing;

$m_2$ is the mass of rigid tubing in the dynamic disturbance zone of BHA, with rigidity coefficient $K_2$;

$K_1$ is the rigidity of the coiled tubing in the assembly;

C is the damping coefficient of the device, depending on hydraulic resistance forces generated at the mud motion with a certain flow in the device, pipes, mud motor, drill bit and annular space in the borehole;

$K_1$ and C form an elastic Maxwell body that is a model of the spring-loaded flow-type piston rod.

Let us assume that dynamic force $P_d$ (t), which is the reaction of the bottom hole to the axial load generated by the device, is applied on mass $m_1$, so for a deformed bottom hole we take it as [8, 12]:

$$P_d = P \cdot \cos(\omega \cdot t), \tag{1}$$

Where P is a static component of the axial force generated by the device;

$\omega$ is the frequency of longitudinal vibrations of the drill bit [13].

$X_i$, i=1.3 is the deviation of masses $m_1$ and $m_2$ from the equilibrium state.

Figure 12:
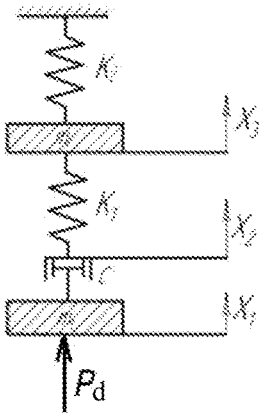
FIG. 12 shows a phenomenological BHA model with an axial load device, a spring K1 and a damper C (hydraulic resistance forces in the device and the assembly below the device, including the MM and the drill bit).

A phenomenological BHA model with an axial load device, a spring $K_1$ and a damper C (hydraulic resistance forces in the device and the assembly below the device, including the MM and the drill bit), is shown in FIG. 12.

Figure 13:
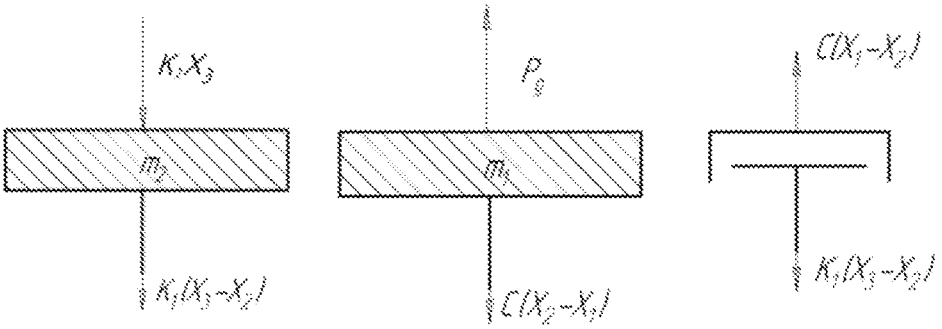
FIG. 13 shows drawing 2—power schematics

A motion equation may be derived based on the Newton's Laws of motion, for which let us remove the connections and replace them with force diagrams showing the character of the mass loading (FIG. 13).

Summing up the dynamic forces relative to the corresponding masses, let us have the motion equations for the studied assembly:

$$\begin{cases} m_2 X_3^{\&\&} + K_2 X_3 + K_1(X_3 - X_2) = 0 \\ m_1 X_1^{\&\&} + C(X_2^{\&} - X_1^{\&}) = P.\cos\omega t \\ K_1(X_3 - X_2) = C(X_2^{\&} - X_1^{\&}) \end{cases}, \tag{2}$$

where $X_i$ is the space coordinates characterizing the dynamic deviations of the corresponding system points from the state of static equilibrium of the studied model;

$X^{\&}_1$ and $X^{\&\&}_1$ are speeds and accelerations of the corresponding points of the system $X_1$ is the disturbing motion of the drill bit along the crushed bottom hole;

$X_2$ is the implementation of the device displacement;

$X_3$ is the behaviour (displacement) of the dynamically disturbed string.

Figure 14:
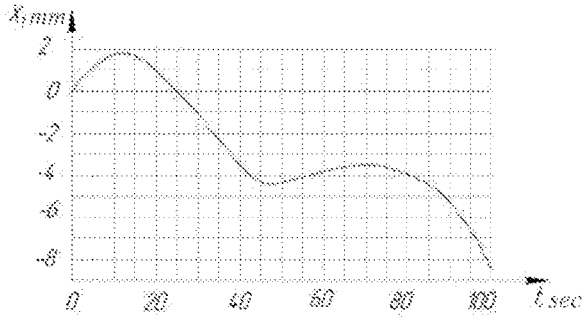
FIG. 14 shows a graph of the dependency of the drill bit movement with the DA during the drilling

The stationary system of linear differential equations (2) of the second order is easily solved by using a complex amplitude method in Mathlab selecting the corresponding single-valued conditions [7,12]. As a result of this calculation, we get the dependency graphs for amplitude displacements $X_i$(t) assuming the allowed stress-strain state of the DA components and all the operating elements of the assembly are in dynamic equilibrium. A graph in FIG. 14 shows the dependency of the spring-loaded plunger rod DA motion from time during the channel drilling.

Figure 15:
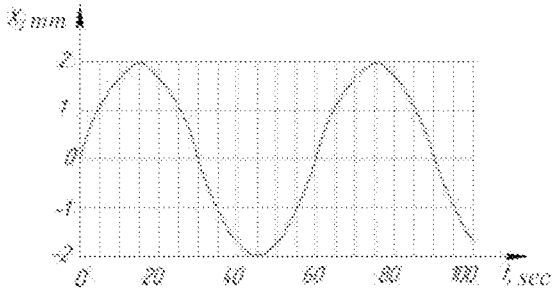
FIG. 15 shows a graph for smoothed characteristic of the dynamically disturbed DA.

The resulting dependency of amplitude modulations, see FIG. 15, shows that with properly selected viscoelastic properties of the Maxwell body the device shall not only ensure the generation of the required axial load on the drill bit, but damper the amplitude oscillations of the drill bit, i.e., increase the mechanical speed of drilling.

The length of the piston rod $L_{cr}$ is selected using known dependencies [14] based on the conditions of its operation in the Eulerian area of stable equilibrium and the allowed values of generated critical stress $\sigma_{cr}$, from the optimal axial load on the drill bit $P_{cr}$, which is regulated by the operating characteristics of the MM: the torque, $M_{ft}$ and the power $N_{ft}$ in the braking mode:

$$L_{cr} = \sqrt{\frac{\pi^2 \cdot E \cdot I}{P_{cr} \cdot \mu^2}}, \quad (3)$$

where E is the modulus of elasticity of the piston rod material, for example, for steel 40 KhN: $E=2.1\cdot10^5$ I is the second moment of the area of the piston rod:

$$I = \frac{\pi(D^4 - d^4)}{64},$$

D is the external diameter of the piston rod 35 mm, d is the internal piston rod diameter, depending on the required damping value (C): 12 . . . 25 mm;

μ is the piston rod length coefficient (for threaded piston rod ends, μ=0.5).

$P_{cr}$ is the range of the optimum axial load on the drill bit, for example, for a small MM VZD 2 D 43.5/6.42, based on the operating torque (70 . . . 80 Nm) and the maximum efficiency, it shall be 0.2 . . . 0.6 kN (manufacturer data);

The permissible stress $\sigma_{cr}$ under critical axial load on the drill bit is determined with a known equation:

$$\sigma_{cr} = \frac{\pi^2 \cdot E}{\lambda^2},$$

where λ is the piston rod flexibility; it is recommended that λ>100 . . . 150 [14]. Due to low $P_{cr}$ values, the length of the body slots and the operating stroke of the piston rod ($L_{cr}$) is selected based on design concept, for example 1 . . . 2 m.

The device with the springless assembly unit works as follows:

The device is installed within the drill string, above the mud motor, for example between the coiled and the rigid tubing. Pressure loss (drop) when the drill fluid flows inside the piston rod, in the coiled tubing, MM, drill bit attachments and the annular space of the channel and the borehole affects the piston rod area and creates hydraulic load that presses the drill bit to the borehole bottom.

The device not only helps to intensify the rock crushing process in the bottom hole but facilitates the advancement of the drill assembly in a long horizontal bore hole of the channel due to mechanical vibrations generated by the pulsations of the key operating as a resonator oscillator applying the load as short pulses perpendicular to the rock face, and more energy can be transferred to crush the rock and accelerate the drilling.

When a profile key is installed in the slots of the device with clearance Δx and Δy, it gives it at least two degrees of freedom, so that at a particular velocity ($V_{fl}$) of the mud of corresponding density ($\rho_{fl}$), when the mud gets onto the front end of the key, it divides into streams and flows around the key on its edges and surfaces, forming vortex-type flows in alternate manner on both sides, and such flows, also in alternate manner, causing pressure changes, which move along the key surface around which the mud flows as elastic waves, affecting both the mud flow and the key, so that a positive reaction is generated in the system "mud flow-key edge", and this allows for the generation of self-excited vibrations with frequency $f_{fl}$, directly proportional to the mud velocity $V_{fl}$ (considering the drill bit vibrations [13]) and inversely proportional to the distance L (see FIG. 5) between the front edge of the key and the entry to the hollow body of the device:

$$f_{fl} = \frac{k \cdot V_{fl}}{L} \quad (11)$$

which changes as the drilled channel is deepened (as the piston rod with the key moves in the hollow body of the device), notably in sync with the dynamic rock crushing by the drill bit, for example, according to quasiharmonic function [9]: $L=(v_k\cdot t)\cdot\sin(\omega_d\cdot t)$, where $v_k$ is the speed of the key and piston rod movement or the speed of mechanical drilling (considering the longitudinal oscillations of the drill bit and BHA occurring at 2 . . . 5 m/sec [13], depending on the size type of the drill bit), t is the time of mechanical drilling, ω∂ is the drill bit vibration frequency, which, depending in the key size and its bending stiffness (EI), may occur at a particular frequency ω notably in several vibration modes [5, 6].

Critical velocity of the self-excited vibrations is determined at the test bench depending on the flow quantity $Q_{fl}$ (drill pump performance). Pressure changes are transferred through the fluid and through the key forming a vibration system with the possibility of self-excited vibrations [10,11]. The self-excited fluid vibrations frequency is directly proportional to the fluid stream velocity $V_{fl}$ (which means it may be regulated in the range from 10 m/sec to 30 m/sec) and inversely proportional to the structural length values of the key l, its position relative to the edge of the adapter bushing L, so it also changes as the axial load is generated and transferred to the DA.

The key surrounded by the vortex-type stream of fluid will oscillate at natural frequency with the possibility of formation, among other, standing flexural waves.

Figure 7:
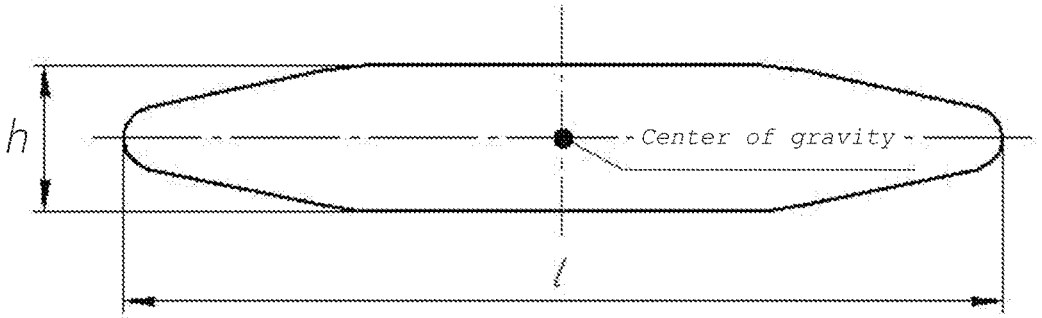
FIG. 7 shows overall dimensions: (h) is the width and (l) is the length of a plate-type symmetrical key.

The main natural frequency of the key oscillations is determined as follows [11]:

$$f_k = k \cdot \frac{h}{l^2} \cdot \sqrt{\frac{E}{\rho}}$$

where h is the key thickness;

l is the key length (key dimensions are indicated in FIG. 7);

E is the modulus of elasticity for the key material, when it is made of steel 40 KhN2MA; ($E=2.1\times10^5$ MPa);

ρ is the density of the key material (7850 kg/m$^3$);

k is a shape factor of the key (identified by experiment on the test bench).

$$\sqrt{\frac{E}{\rho}} = 5172 \text{ m/sec}$$

is the velocity of elastic waves propagation in an oscillating key.

For example, with h=0.01 . . . 0.015 m; l=0.05 . . . 0.1 m; k=2 . . . 5; then natural vibrations frequency of the key is $f_k$=5 . . . 40 kHz.

With $Q_{fl}$=4 . . . 5 l/sec (required and sufficient value for bottom hole cleaning and conveying the cuttings from 58-60 mm channels and the optimum operating mode for a small MM, such as 2 D 43.5/6.42), considering the BHA vibration velocity: $V_{fl}$=10 . . . 40 m/sec, then the self-excited vibrations frequency: $f_{fl}$, =1 . . . 20 kHz.

By selecting the $V_{fl}$, (changing the drill pump rate), key dimensions and position, it is possible to synchronize frequencies $f_{fl}$ and $f_k$ so that $f_{fl} \approx f_k$, which would lead to operation mode close to resonant, i.e. The key in the device will work as a resonator, intensifying relatively low mud flow vibrations at the discharge of the positive-displacement mud pump. Such operation mode close to resonant would eliminate or considerably reduce the risks of sticking of the DA.

The invention claimed is:

1. An axial load device configured to be placed in a drill string assembly with a downhole motor, the axial load device comprising a hollow cylinder body with a sealing bush, and a spring-loaded flow-type piston rod with a key, wherein:

the hollow cylinder body comprises two-way longitudinal key slots along an inner generator line of the hollow cylinder body, the key is inserted in the two-way longitudinal key slots, the key comprising longitudinal and transverse gaps and a profiled surface adapted to move along the two-way longitudinal key slots together with the spring-loaded flow-type piston rod, the transverse gaps are configured so that the key has at least two degrees of freedom in the two-way longitudinal key slots and in slots of the flow-type piston rod for axial movements relative to the cylinder body, thereby allowing mud on the front of the key to flow around both sides of the key, a natural vibration frequency of the key is directly proportional to a length of the key and a velocity of propagation of generated flexural wave over the key and inversely proportional to the square of a thickness of the key, and a length of the two-way longitudinal key slots is determined based on a maximum stroke of the flow-type piston rod operating in the Eulerian area of stable equilibrium, considering its moment of inertia of a cross section and a permissible critical stress generated by an optimum axial load on a drill bit of the drill string.

2. The axial load device of claim 1, wherein the two-way longitudinal key slots are parallel to an axis of the hollow cylinder, or wherein the two-way longitudinal key slots are in the shape of a helical evolute spiral wherein a rise angle of the helical evolute spiral is the same as the angle of possible torsion of the drill string under the reactive torque of the motor, but having an opposite sign.

3. The axial load device of claim 1, wherein the key is made as an elastic plate with tapered or rounded ends, or wing-shaped flat with key end positions being skewed relative to each other, or with a spherical front surface, symmetrical or asymmetrical drop-shaped, placed in the two-way longitudinal key slots with a side closest to the gravity center toward the flow of mud or turned with the farther side from the gravity center.

* * * * *